US006021626A

United States Patent [19]

Goodman

[11] Patent Number: 6,021,626

[45] Date of Patent: Feb. 8, 2000

[54] FORMING, PACKAGING, STORING, DISPLAYING, AND SELLING CLOTHING ARTICLES

[75] Inventor: David H. Goodman, Newark, Del.

[73] Assignee: Goodvest Corporation, Newark, Del.

[21] Appl. No.: 08/904,317

[22] Filed: Jul. 31, 1997

Related U.S. Application Data

[63] Continuation of application No. PCT/US97/12110, Jul. 11, 1997

[60] Provisional application No. 60/021,705, Jul. 12, 1996, and provisional application No. 60/036,977, Jan. 29, 1997.

[51] Int. Cl.[7] ..... B65B 63/04

[52] U.S. Cl. ..... 53/438; 53/429; 53/436; 53/430; 53/442; 53/449

[58] Field of Search ..... 206/278, 457, 206/524.8; 53/436, 430, 438, 429, 442, 449

[56] References Cited

U.S. PATENT DOCUMENTS

| | | |
|---|---|---|
| 2,383,389 | 8/1945 | Illion . |
| 2,875,877 | 3/1959 | Hoban . |
| 3,149,708 | 9/1964 | Forse . |
| 3,354,576 | 11/1967 | Gralnick . |
| 3,355,064 | 11/1967 | Schlaf . |
| 3,458,966 | 8/1969 | Dunbar et al. . |
| 3,521,424 | 7/1970 | Wirfel . |
| 3,707,825 | 1/1973 | Bell et al. . |
| 3,731,841 | 5/1973 | Schlaf . |
| 3,791,554 | 2/1974 | Nagatani et al. . |
| 3,802,581 | 4/1974 | Frederick . |
| 4,037,386 | 7/1977 | Sjoman . |
| 4,046,243 | 9/1977 | Valentine . |
| 4,185,730 | 1/1980 | Roes et al. . |
| 4,300,041 | 11/1981 | Nama . |
| 4,340,150 | 7/1982 | Guibord et al. . |
| 4,449,040 | 5/1984 | Matsuoka et al. . |
| 4,523,335 | 6/1985 | Scrivens . |
| 4,531,341 | 7/1985 | Bittner . |
| 4,669,596 | 6/1987 | Capers et al. . |
| 4,674,618 | 6/1987 | Eglise et al. . |
| 4,750,616 | 6/1988 | Bridges . |
| 4,757,669 | 7/1988 | Areblom et al. . |
| 4,802,577 | 2/1989 | O'Leary . |
| 4,809,837 | 3/1989 | Hayashi . |
| 4,835,939 | 6/1989 | Thomas et al. . |
| 4,840,013 | 6/1989 | Perrella . |
| 4,893,727 | 1/1990 | Near . |
| 4,903,815 | 2/1990 | Hirschfeld et al. . |
| 4,922,685 | 5/1990 | Hodges . |
| 4,928,831 | 5/1990 | Kirsch . |
| 4,951,308 | 8/1990 | Bishop et al. . |
| 5,025,140 | 6/1991 | Varley . |
| 5,042,227 | 8/1991 | Merry . |
| 5,097,534 | 3/1992 | Viemeister et al. . |
| 5,172,629 | 12/1992 | Merry . |
| 5,228,271 | 7/1993 | Wallace . |
| 5,313,393 | 5/1994 | Varley et al. . |
| 5,499,707 | 3/1996 | Steury . |
| 5,503,274 | 4/1996 | Toffler et al. . |
| 5,509,572 | 4/1996 | Curtis . |
| 5,572,004 | 11/1996 | Raimann . |
| 5,593,029 | 1/1997 | Both . |
| 5,619,024 | 4/1997 | Kolls . |
| 5,638,985 | 6/1997 | Fitzgerald et al. . |
| 5,692,606 | 12/1997 | Elmaleh . |
| 5,813,538 | 9/1998 | Kaufman . |

FOREIGN PATENT DOCUMENTS

| | | |
|---|---|---|
| 295 03 946 | 6/1995 | Germany . |

*Primary Examiner*—Daniel B. Moon
*Attorney, Agent, or Firm*—Finnegan, Henderson, Farabow, Garrett & Dunner, L.L.P.

[57] ABSTRACT

Clothing apparel is vended by forming the clothing apparel into a compact shape, inserting the clothing apparel and a container, and vending the clothing material and container from a standard beverage vending machine.

28 Claims, 5 Drawing Sheets

FORMING, PACKAGING, STORING, DISPLAYING, AND SELLING CLOTHING ARTICLES

RELATED APPLICATIONS

This application is a continuation of PCT International Application PCT/US97/12110 (PCT Publication No WO9802355) having an international filing date of Jul. 11, 1997, and claims the benefit of U.S. Provisional Application Ser. No. 60/021,705, filed Jul. 12, 1996 and U.S. Provisional Application Ser. No. 60/036,977, filed Jan. 29, 1997, the contents of which are relied upon and incorporated herein by reference.

BACKGROUND OF INVENTION

The invention relates to packaged clothing articles, and methods and apparatus for forming, packaging, storing, displaying, and selling clothing articles. Prior methods and apparatus for forming, packaging, storing, displaying, and selling clothing articles have various drawbacks.

SUMMARY OF THE INVENTION

Accordingly, the present invention is directed to prepackaged clothing articles, and methods and apparatus for forming, packaging, storing, displaying, and selling clothing articles that overcome one or more of the problems due to the limitations and disadvantages of the related art.

Additional features and advantages of the invention will be set forth in the description which follows, and in part will be apparent from the description, or may be learned by practice of the invention. The objectives and other advantages of the invention will be realized and attained by the process, apparatus, and articles particularly in the written description, claims, and drawings that follow.

To achieve these and other advantages and in accordance with the purpose of the invention, as embodied and broadly described, one aspect of the invention provides a method and apparatus for vending clothing apparel, forming the clothing apparel into a compact shape, inserting the clothing apparel into a container, and vending the clothing apparel and container from a standard beverage vending machine. It is preferable that the container is generally the size and shape of a standard beverage can.

In accordance with another aspect of the invention, a method is set forth for providing a visored cap with a prerolled visor, comprising, forming the visored cap into a rolled shape, inserting the rolled visored cap into a container, setting the rolled shape of the visored cap by allowing the visored cap to remain in the container for a sufficient period of time to set the roll of the visor.

In accordance with another aspect of the invention, a method is set forth for providing clothing apparel comprising, providing a cylindrical can, highly compressing clothing apparel into the shape of the can, and inserting the highly compressed clothing apparel into the can.

It is to be understood that both the foregoing general description and the following detailed description are exemplary and explanatory and are intended to provide further explanation of the invention as claimed.

The accompanying drawings are included to provide a further understanding of the invention, and are incorporated in and constitute a part of this specification, illustrate several embodiments of the invention, and together with the description serve to explain the principles of the invention.

DETAILED DESCRIPTION OF THE PREFERRED EMBODIMENTS

Figure 1:
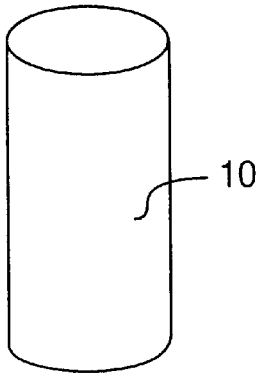
FIGS. 1 and 1A show a perspective view of a compressed clothing article.

The drawings and description show and describe various methods and apparatus for forming, packaging, storing, displaying, and selling clothing articles, also known as clothing apparel. Referring to FIG. 1, there is shown, rather schematically, a compressed clothing article 10. Article 10 may be a T-shirt, sweatshirt, nightshirt or other clothing item. Various methods of compressing fabric, and particularly clothing articles to a substantially rigid article having a relatively small volume are known in the prior art. One such method is discussed in U.S. Pat. No. 5,172,629. For example, a conventional T-shirt, sized for an adult, may readily be compressed to a disk between about 1 inch and 4 inches in height and two inches and four inches in diameter. By use of known compression techniques, the clothing article is not damaged, and may be recovered from its compressed state by the consumer.

Various methods of compressing fabric, and particularly clothing articles to a substantially rigid article having a relatively small volume, are known in the prior art. Generally, under these methods, clothing articles are inserted into a mould or dye having a cavity which is closed at one end. A plunger, dimensioned to form a close sliding fit in the cavity, is then inserted into the cavity, and a desired pressure applied to it for a certain period of time. By use of these methods, the clothing article is compressed sufficiently to form a generally stable, solidified body, which may be returned to its original shape by an end user through manipulation or by adding water to the article. Generally the shape of the cavity in the dye and the shape of the plunder, as well as the distance into the cavity the plunger must travel, are determined empirically based on the size and shape of the compressed clothing article.

In accordance with the present invention, the mould contains a cylindrical cavity and a cylindrical plunger of approximately the diameter of the desired shape of the compressed clothing article. The depth in the cavity that the plunder is inserted during compression will be determined by the desired height or length of the compressed clothing article. The amount of pressure to be applied to the plunger and the amount of time the pressure is applied, will vary depending upon the material composition and size of the clothing article before compression and the desired shape of the compressed clothing article, and is determined so that the clothing article is compressed sufficiently to forma generally stable, solidified body, which may be returned to its original shape by an end user through manipulation or by adding water to the article.

Figure 2:
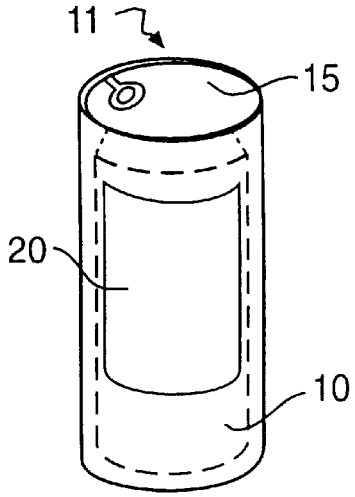
FIGS. 2 and 2A show a perspective view of a compressed clothing article contained in a metal can.

Referring to FIG. 2, there is shown a compressed clothing article 10 contained in a metal can 15. Compressed clothing article 10 is depicted in broken lines. Metal can 15 may be made a conventional metal can of steel, aluminum, or other metals, conventionally employed for storage of food or beverages. According to one embodiment of the invention, a standard sized beverage can, preferably of steel, sized to contain either 12, 16 or 20 ounces of liquid, may be employed. A conventional pull ring and scribed line 11 on the lid may be provided to permit the can to be opened by the consumer. A conventional slip cover lip may also be used. Conventional processes of forming the cylindrical side and one circular end of the can, and attaching the end to the side, may be used. The clothing article may be shrink wrapped in clear plastic using conventional methods to ease insertion into and removal from the can. The clothing article is then placed in the can, and the opposite circular end is attached to the cylindrical side in a conventional manner, thereby sealing the can against air and moisture.

As shown in FIG. 2, text and graphical material may be applied directly to the outer surface of can 15 by screen printing or other conventional techniques. Alternatively, a label 20 is applied to the exterior side wall of can 15. Glue is applied to fix label 20 to the side wall of can 15. Label 20, which may be of paper, has printed thereon text and graphical material portraying and describing the clothing article. Label 20 may cover all of the surface of can 15 or any selected portion thereof. The text and graphical material, as noted above, may portray and describe the clothing article contained in the can. The can may also be decorated with other promotional information, so as to serve as a collectible or souvenir memorializing an event. Promotional materials or collectibles may be included in the can as well, for example, baseball cards or action figures.

In a preferred embodiment, a T-shirt or other clothing article or articles is compressed to a cylinder of between about 5 inches and about 6 inches, and preferably about 6 inches, in height, and between about 2 inches and 2½ inches in diameter. The size and shape of the clothing article and the can are preferably about the same. The T-shirts or other clothing articles may be imprinted with words, slogans or other designs. The clothing article may be shrink wrapped in clear plastic using conventional methods to ease insertion into and removal from the can. The T-shirt or other clothing article or articles are then inserted in a cylindrical can between about 6 inches and about 6½ inches, and preferably about 6¼ inches in height, and between about 2½ inches and 2¾ inches, and preferably about 2⅝ inches, in diameter. The clothing article or articles are preferably sufficiently large to minimize movement of the articles within the interior of the can. The can is preferably made of steel.

Figure 1A:
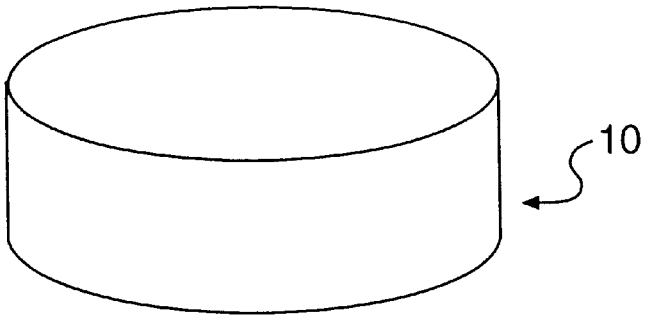
Figure 2A:
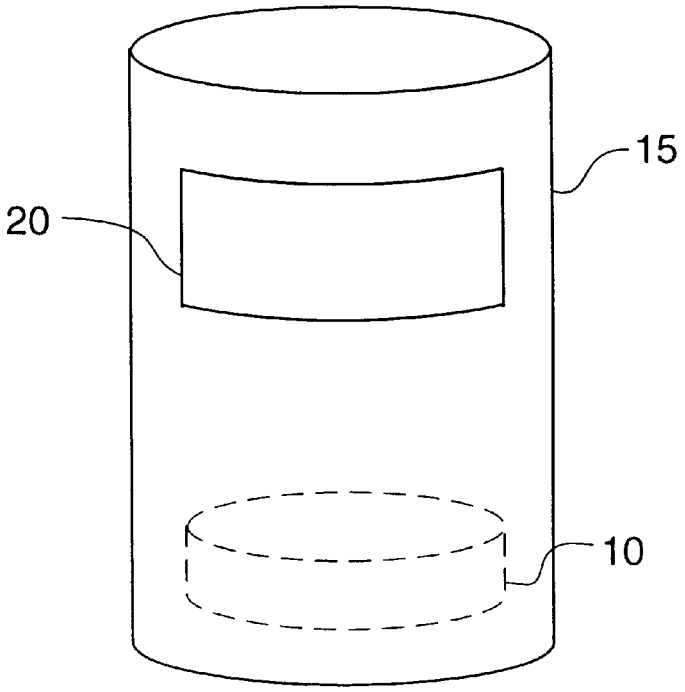

In a preferred embodiment shown in FIGS. 1A and 2A, a T-shirt is compressed to a disk of between about 2½ inches and about 3 inches, and preferably about 3 inches, in height, and between about 2¾ inches and 3 inches in diameter. The T-shirt is then inserted in a cylindrical can between about 3 inches and about 3½ inches, and preferably about 3½ inches, in height, and between about 3¼ inches and 3½ inches, and preferably about 3½ inches, in diameter. The can is preferably made of aluminum.

In another preferred embodiment, a T-shirt or other clothing articles are compressed to a cylinder of between about 4¼ inches and about 4¾ inches, and preferably about 4¾ inches, in height, and between about 2 inches and 2½ inches in diameter. The clothing article may be shrink wrapped in clear plastic using conventional methods to ease insertion into and removal from the can. The T-shirt or other clothing articles are then inserted in a cylindrical can between about $4^{11}/_{16}$ and $4^{15}/_{16}$ inches, and preferably about $4^{13}/_{16}$ inches, in height, and between about 2½ and 2¾ inches, and preferably about 2⅝ inches, in diameter. The can is preferably made of steel.

In another alternative embodiment of the invention shown in FIGS. 5–14, the clothing article may be a structured or non-structured cap such as a visored cap or a baseball cap, having a flexible bill or visor 50, preferably made of malleable plastic, and a crown 60, preferably made of a flexible fabric such as cotton, wool or synthetic materials. The cap is rolled to a size sufficiently small to fit within a can 48, shown in FIG. 7, but it is not compressed.

Figure 5:
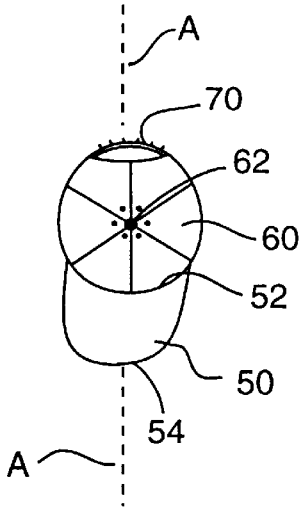
FIGS. 5–7 show top views of sequential steps for forming a visored cap into a rolled shape according to an aspect of the invention.
Figure 5A:
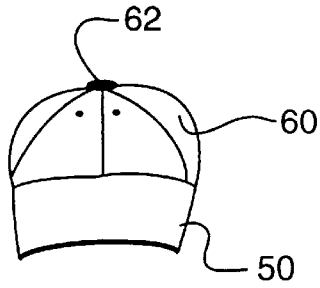
FIG. 5A shows a front view of the visor cap shown in FIG. 5.
Figure 6:
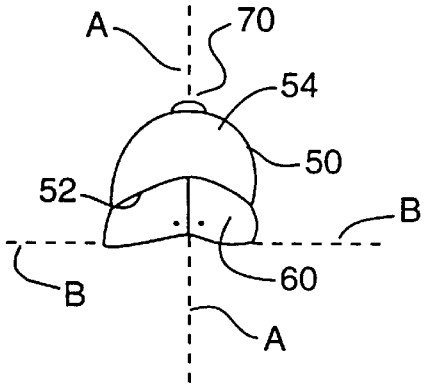
Figure 6A:
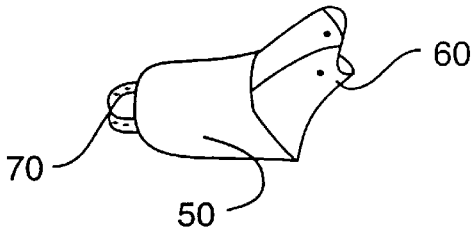
FIG. 6A shows a side view of the visored cap shown in FIG. 6.
Figure 7:
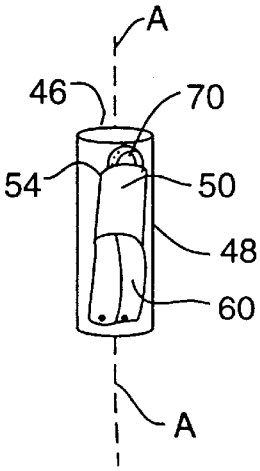
Figure 7A:
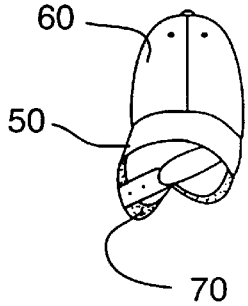
FIG. 7A shows a front view of the visored cap shown in FIG. 7.

As shown in FIGS. 5–7, one preferred method of rolling either a fixed size or an adjustable cap for insertion and storage in the can is to pull the adjustable plastic eyelet or fabric buckle strap 70 located at the rear of the cap forward towards and underneath the bill 50 to form a loop of approximately 1 inch in diameter, which protrudes from the front edge or outer edge 54 of the bill 50. The center 62 of the crown 60 or top of the cap, where the button is located, is pulled tight to about the rear edge or inner edge 52 of the bill. The visored cap is then rolled about its longitudinal, front-rear axis of symmetry A into a cylindrical shape having a diameter of about 2 inches, and inserted in a can with the loop of the strap 70 protruding towards the opening 46 of the can 48. After the can 48 is opened by the consumer, the loop serves as a convenient mechanism for the consumer to remove the cap from the can.

Figure 8:
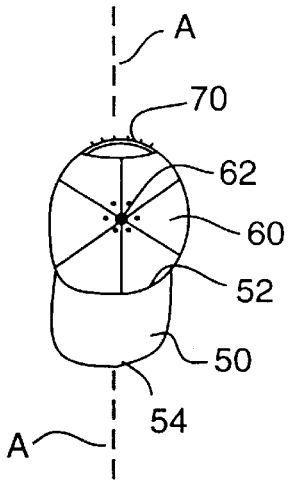
FIGS. 8–10 show top views of sequential steps for forming a visored cap into a rolled shape according to another aspect of the invention.
Figure 8A:
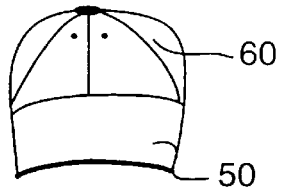
FIG. 8A shows a front view of the visored cap shown in FIG. 8.
Figure 9:
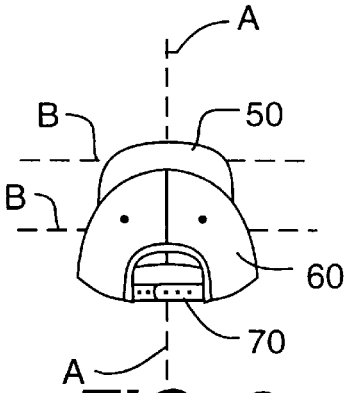
Figure 9A:
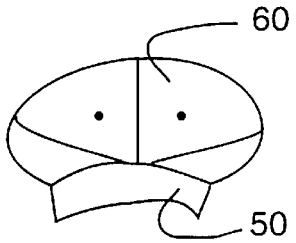
FIGS. 9A and 9B show a front view and a side view, respectively, of the visored cap shown in FIG. 9.
Figure 9B:
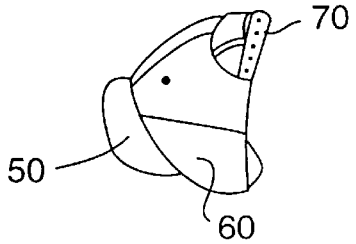
Figure 10:
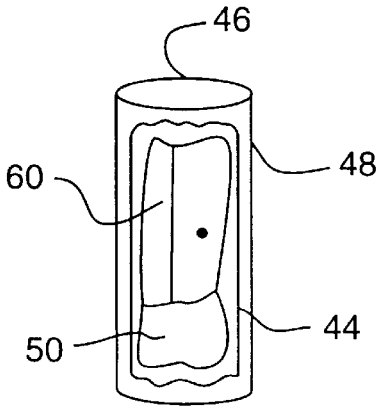
Figure 10A:
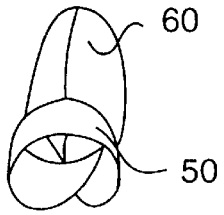
FIGS. 10A and 10B show a front view and a side view, respectively, of the visored cap shown in FIG. 10.
Figure 10B:
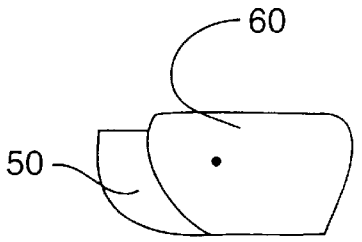

As shown in FIGS. 8–10, another preferred method is provided for forming a visored cap for insertion in a can. The center 62 of the crown 60, or top of the cap, where the button is located, is pulled to about the inner edge 52 of the bill. This results in various laterally extending fold areas B. The bill is then rolled into a cylindrical shape having a diameter of approximately 2". The cap is maintained in a rolled form by hand or by mechanical grip until inserted in a can. Alternatively, the cap is maintained in a rolled form by inserting it into a cylindrical sleeve 44 of clear PVC or similar material having one or two openings, and heat sealed to ease insertion into and removal from the can 48.

As shown in FIGS. 11–14, another preferred method of rolling a visored cap for insertion and storage in a can is to collapse the front portion 64 of the crown so that it rests on top of the bill, with a fold being created about halfway between the center 62 of the crown and the inner edge 52 of the bill. The rear of the cap, or the adjustable strap on an adjustable cap, is then pulled forward to the outermost edge of the bill. The results in various laterally extending fold areas B. The bill is then rolled to form a cylindrical shape having a diameter of approximately two inches. As with the other embodiment, the cap is then maintained in rolled form by hand or by mechanical grip until inserted in a can. Alternatively, the hat is inserted into a cylindrical sleeve of clear PVC or similar material, having an opening at one or both ends, and heat sealed to maintain the hat in rolled form and ease insertion into and removal from the can.

Figure 11:
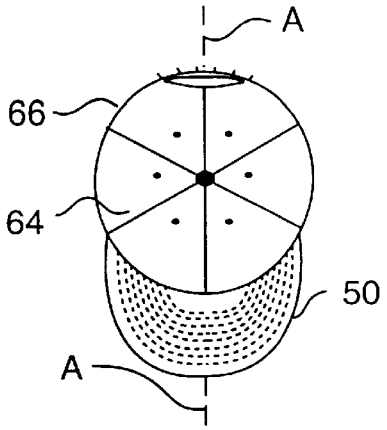
FIGS. 11–14 show top views of sequential steps for forming a visored cap into a rolled shape according to another aspect of the invention.
Figure 11A:
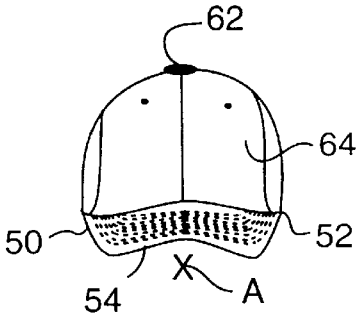
FIGS. 11A, 12A, 13A, and 14A, show respective front views of the visored cap shown in FIGS. 11, 12, 13, and 14.
Figure 12:
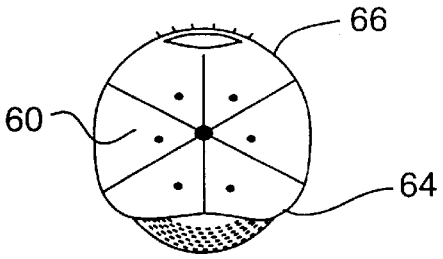
Figure 12A:
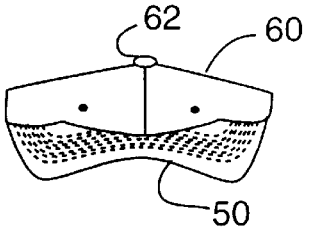
Figure 13:
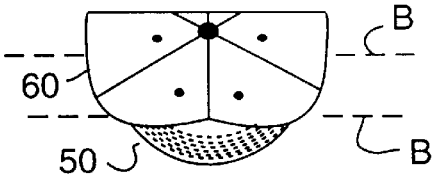
Figure 13A:
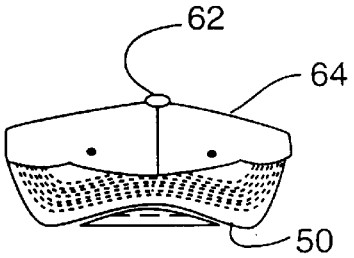
Figure 14:
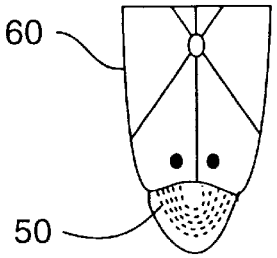
Figure 14A:
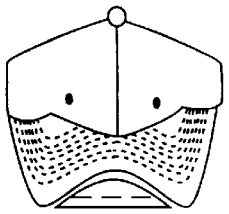

Each technique results in minimal wrinkling. Each technique also results in a pre-formed well-rounded bill shape preferred by most consumers, for example as shown in FIG. 11A, a bilaterally symmetrical upwardly convex curve about longitudinal front-rear axis of symmetry A. The preferred can size for standard one-size-fits-all caps is approximately 6¼ inches in height, and between about 2½ and 2¾ inches in diameter. The can is sized to minimize movement of the hat within the can and to accommodate the functioning of a vending machine.

Figure 3:
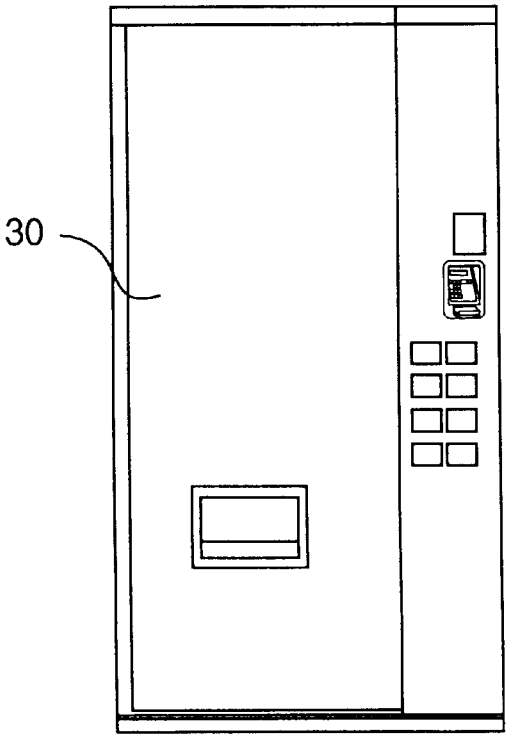
FIG. 3 shows a front view of a machine for display and vending of cans containing compacted, compressed, or specially folded and/or rolled clothing articles packaged in metal cans.
Figure 4:
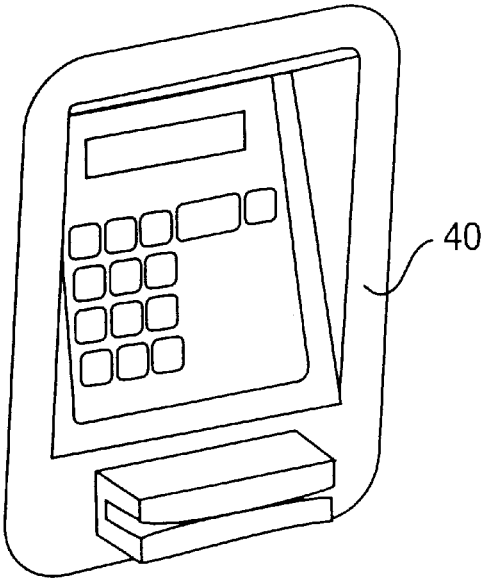
FIG. 4 shows a perspective view of a vending machine control panel with a credit card processor for a credit card, smart card, debit card, and/or other purchase card.

Referring now to FIG. 3, there is shown a vending machine 30. Vending machine 30 may be, by way of example, a conventional vending machine used for the vending of canned beverages. Such machines are available, in a variety of capacities and configurations, from numerous vendors, including by way of example Dixie/Narco of Williston, S.C. In such a machine, cans are stored in numerous stacks. If more than one flavor, brand or type of beverage is stocked in the machine, the types of beverage are arranged by type. Such a machine is stocked by a human user who unlocks a lock to permit a door to be opened to provide access to the interior of the vending machine. To obtain goods from the machine, a user operates a payment mechanism that detects when sufficient funds have been deposited to make a purchase. The user then presses one of several buttons to select an item for purchase. The purchased item is permitted to fall to a delivery shelf by conventional techniques. These are stored (but not illustrated in FIG. 3) in vending machine 30 sealed cans 15 containing compressed or folded clothing articles 10. Vending machine 30 may be provided with a display, such as a liquid crystal monitor, and a speaker to display images and project audio from a looping videotape or CD-ROM containing advertising for the products. Vending machine 30 may also promote not only the products contained in the machine, but also related products or events.

Vending machine 30 may accept cash and/or may have an automated credit card reader and verification device 40. The credit card reader could read various credit cards, smart cards, debit cards, and/or other purchase cards. In accordance with conventional credit card reader and verification device technology, credit card reader 40 contains a card reader, a modem coupled to a telephone line, and suitable processors and memory to obtain card identification information magnetically encoded on a credit card, open a telephone connection to a credit card verification facility, transmit via such telephone connection information identifying the vending machine, the credit card, and the amount of the proposed purchase, to the credit card verification facility, receive an indication of purchase approval or disapproval, cause the vending machine to dispense product upon receipt of purchase approval, cause the vending machine to dispense product upon receipt of purchase approval, print a customer receipt, and transmit confirmation of the transaction to a processing facility. Device 40 may also be configured to transmit information, such as purchase information and inventory information, to a remote computer of the owner and/or operator of the vending machine. As shown, device 40 also is provided with a numeric keypad to permit entry of numeric information, such as personal identification numbers for use of debit cards. The credit card reader and verification device 40 also contains a display for providing use instructions, information regarding card approval or disapproval, and other information. Device 40 is available from numerous vendors including, by way of example, NBS Technologies of Montreal, Quebec, Canada.

Vending machine 30 may be equipped with device 40 to be used for the purchase of clothing articles 10 contained in cans 15. Device 40 is highly advantageous, rather than a coin mechanism, because the prices of clothing articles are sufficiently high to render credit card purchases feasible and even preferred over cash purchases.

There are various advantages to the process of the invention over the prior art. In the prior art, clothing items, and particularly T-shirts, that have not been compressed, are displayed in the store on hangers or folded and placed on flat display surfaces. As consumers inspect the clothing items in the store, the clothing items are typically handled many times. As a result, the clothing items frequently become soiled or damaged and can no longer be sold.

When clothing is compressed before shipping, it is conventionally shrink-wrapped in clear plastic. Clothing items that have been compressed and shrink wrapped occupy a smaller volume than clothing items that are being shipped conventionally, and are not subject to direct handling by consumers, and are therefore advantageous when compared with conventional shipping and display of clothing items. However, the appearance of a compressed clothing article that has been shrink-wrapped in clear plastic is not particularly attractive to the consumer. Moreover, compressed clothing items that have been shrink wrapped in plastic tend to slide when stacked, and therefore fall readily when stacked on tables or shelves for in-store display.

The method of the present invention provides a superior method for displaying compressed clothing articles, by providing a surface for direct printing of information or for application of printed labels. Moreover, cans containing compressed clothing items are rigid and uniform and therefore can readily be stacked for display; shrink-wrapped clothing items cannot be readily stacked. A sealed can also provides protection against sharp objects which would penetrate a plastic film.

Cans containing clothing articles can readily be adapted to sale in vending machines. Clothing that has been packaged in shrink wrap, clear plastic bags, or other conventional packaging cannot be placed in or dispensed efficiently from conventional vending machines. As the cans are rigid and of a uniform size, they are well suited to mechanical handling. Clothing articles of different types or of different sizes, when packaged in shrink wrap or plastic bags, are not of uniform size and shape and, even when compressed, not as rigid as sealed cans.

The use of cans of conventional sizes permits the use of existing vending and dispensing machines. The use of vending machines also permits the sale of clothing at locations that have too low a volume, are too small, or otherwise are unsuitable for the use of clerks to accomplish sales. The vending machine may be located at movie theaters, restaurants, hotels, stadiums, airports, train stations, shopping malls, and other locations. As there is no handling of the cans after the vending machines are loaded, there is less opportunity for shrinkage than there is when clerks and consumers handle the merchandise at retail.

There are advantages to shipping clothing articles compressed in cans. Shipping compressed clothing articles in cans results in the in volume savings of 10–12%. Also there is no need for hangers. Cans come ready to display. Conventionally, shirts are shipped bulk folded in lots of 12 and recipients must count by hand each shirt to confirm delivery amount. Counting cans, which are uniform in size allows recipient to conveniently confirm amount received (counting one layer, multiplying by number of layers, etc).

It will be apparent to those skilled in the art that various modifications and variations can be made without departing from the spirit or scope of the invention. Thus, it is intended that the present invention cover the modifications and variations of this invention provided that they come within the scope of the appended claims and their equivalents.

What is claimed is:

1. A method for packaging and vending clothing apparel, comprising:

forming the clothing apparel into a compact shape;

inserting the clothing apparel into a cylindrical container; and vending the clothing apparel and container from a vending machine.

2. The method of claim 1 wherein the cylindrical container is of a size and shape to house approximately twelve fluid ounces.

3. The method of claim 1 wherein the cylindrical container is of a size and shape to house approximately twelve fluid ounces and has a removable top.

4. The method of claim 1 wherein the cylindrical container is of a size and shape to house approximately twelve fluid ounces, and the vending machine includes a purchase card processor, and the vending step includes making the clothing apparel and container available in response to processing a purchase card.

5. The method of claim 1 wherein the clothing apparel includes a visored cap.

6. The method of claim 1 wherein the clothing apparel includes a visored cap and wherein the forming step includes forming the visored cap into a rolled shape.

7. The method of claim 1 wherein the cylindrical container is of a size and shape to house approximately twelve fluid ounces, wherein the clothing apparel includes a visored cap, and wherein the forming step includes forming the visored cap into a rolled shape.

8. The method of claim 1 wherein the cylindrical container is of a size and shape to house approximately sixteen fluid ounces, wherein the clothing apparel includes a visored cap, and wherein the forming step includes forming the visored cap into a rolled shape.

9. The method of claim 1 wherein the container is made of a material including steel.

10. The method of claim 1 wherein the container includes a pull ring top.

11. The method of claim 1 including prepackaging the clothing apparel before inserting the clothing apparel into the container.

12. The method of claim 1 including prepackaging the clothing apparel before inserting the clothing apparel into the container by shrink wrapping the clothing apparel.

13. The method of claim 1 wherein the clothing apparel includes a visored cap, wherein the forming step includes forming the visored cap into a rolled shape, and including inserting another article into the container in addition to the rolled visored cap.

14. The method of claim 1 wherein the clothing apparel includes a visored cap having a visor and a rear strap diametrically opposite the visor, and the forming includes moving the strap to extend forward of the visor and forming the visored cap into a rolled shape.

15. The method of claim 1 wherein the clothing apparel includes a visored cap having a visor and a rear strap diametrically opposite the visor, wherein the forming includes moving the strap to extend forward of the visor and forming the visored cap into a rolled shape, and wherein the inserting includes inserting the rolled visored cap into the container with the strap end facing out of an openable end of the container.

16. The method of claim 1 wherein the clothing apparel includes a visored cap having a visor with a front edge and a rear edge, a crown having a front portion, a center, and a rear portion; and wherein the forming includes moving the front portion of the crown to a backward position behind the visor, making a laterally extending fold area in the crown halfway between the center of the crown and the rear edge of the visor, moving the center of the crown to a forward position over the visor of the cap, making a laterally extending fold area at the center of the crown, and subsequently rolling the visored cap into a rolled shape.

17. The method of claim 1 wherein the clothing apparel includes a visored cap having a visor with a front edge and a rear edge, a crown having a front portion, a center, and a rear portion; and wherein the forming includes moving the front portion of the crown over the visor, making a laterally extending fold area between the front portion of the crown and the rear edge of the visor, making a laterally extending fold area in the crown halfway between the center of the crown and the rear edge of the visor, and rolling the visored cap into a rolled shape.

18. The method of claim 1 wherein the container is a can and the forming step includes highly compressing the clothing apparel into the cylindrical shape of the can.

19. The method of claim 1 wherein the container is a steel can and the forming step includes highly compressing the clothing apparel into the cylindrical shape of the can.

20. The method of claim 1 wherein the container is an aluminum can and the forming step includes highly compressing the clothing apparel into the cylindrical shape of the can.

21. The method of claim 1 wherein clothing apparel is a T-shirt, the container is a can and the forming step includes highly compressing the clothing apparel into the cylindrical shape of the can.

22. The method of claim 1 wherein the vending machine is located at a movie theater.

23. The method of claim 1 wherein the vending machine is located at a restaurant.

24. The method of claim 1 wherein the vending machine is located at a hotel.

25. The method of claim 1 wherein the vending machine is located at a stadium.

26. The method of claim 1 wherein the vending machine is located at an airport.

27. The method of claim 1 wherein the vending machine is located at a train station.

28. The method of claim 1 wherein the vending machine is located at a shopping mall.

* * * * *